United States Patent [19]

Metcalf

[11] 4,184,915

[45] Jan. 22, 1980

[54] DRAINAGE FOIL APPARATUS WITH INDIVIDUALLY REPLACEABLE CERAMIC SEGMENTS

[75] Inventor: Robert L. Metcalf, Beaverton, Oreg.

[73] Assignee: Wilbanks International, Inc., Hillsboro, Oreg.

[21] Appl. No.: 967,864

[22] Filed: Dec. 8, 1978

[51] Int. Cl.[2] ..... D21F 1/48; D21F 1/54

[52] U.S. Cl. ..... 162/352; 162/374

[58] Field of Search ..... 162/352, 374

[56] References Cited

U.S. PATENT DOCUMENTS

| | | | |
|---|---|---|---|
| Re. 29,418 | 9/1977 | Hunt | 162/352 X |
| 2,928,465 | 3/1960 | Wrist | 162/352 |
| 3,140,225 | 7/1964 | Truxa | 162/352 |
| 3,165,440 | 1/1965 | Jordansson | 162/352 |
| 3,201,308 | 8/1965 | Goddard et al. | 162/352 |
| 3,377,236 | 4/1968 | Roecker | 162/352 X |
| 3,393,123 | 7/1968 | Klingler et al. | 162/374 X |
| 3,393,124 | 7/1968 | Klingler et al. | 162/352 |
| 3,446,702 | 5/1969 | Buchanan | 162/374 |
| 3,520,775 | 7/1970 | Truxa | 162/352 |
| 3,535,201 | 10/1970 | Reynolds et al. | 162/352 |
| 3,577,316 | 5/1971 | Piette | 162/352 |
| 3,619,363 | 11/1971 | Pherson | 162/352 |
| 3,645,844 | 2/1972 | Grenier | 162/374 X |
| 3,713,610 | 1/1973 | Grenier | 162/374 X |
| 3,732,142 | 5/1973 | Beacom et al. | 162/374 |
| 3,743,574 | 7/1973 | Walser et al. | 162/352 |
| 3,762,991 | 10/1973 | Justus | 162/352 |
| 3,778,342 | 12/1973 | Charbonneau | 162/352 |
| 3,793,140 | 2/1974 | Corbellini | 162/352 |
| 3,836,428 | 9/1974 | McConaughty | 162/374 X |
| 3,870,597 | 3/1975 | Getman et al. | 162/352 |
| 3,953,284 | 4/1976 | Euälahti | 162/352 |
| 4,004,969 | 1/1977 | Beauchemin | 162/352 |
| 4,061,532 | 12/1977 | Biondetti | 162/352 |

FOREIGN PATENT DOCUMENTS

| | | | |
|---|---|---|---|
| 1958758 | 6/1971 | Fed. Rep. of Germany | 162/352 |

*Primary Examiner*—Richard V. Fisher

*Attorney, Agent, or Firm*—Klarquist, Sparkman, Campbell, Leigh, Hall & Whinston

[57] ABSTRACT

A drainage foil apparatus for removing liquid from material carried across the foil by a moving foraminous conveyor such as the wood pulp stock in a paper making machine, is described. The drainage foil apparatus includes a foil having at least a nose portion of ceramic material formed by laterally spaced ceramic segments. The segments are mounted on a support means enabling individual replacement of such segments when they become damaged or worn. The support means includes a mounting member of metal which extends into a slot in a lower surface portion of the ceramic segment and is bonded thereto by a bonding material provided within the slot. For easy replacement of the ceramic segments, the mounting member and slot are shaped to enable each segment to be inserted and removed from such mounting member without moving other segments. In one embodiment, the ceramic nose portion is separate from the rear portion of the foil, such rear portion being made of a different material such as a synthetic plastic. In another embodiment, both the nose portion and the rear portion of the foil are made integral with the same ceramic member. In the first embodiment, the foil rear portion member may be provided with a different foil angle on its top and bottom surfaces and is mounted on the support means so that it can be inverted, to enable either surface to be the upper foil surface.

19 Claims, 4 Drawing Figures

DRAINAGE FOIL APPARATUS WITH INDIVIDUALLY REPLACEABLE CERAMIC SEGMENTS

BACKGROUND OF INVENTION

The subject matter of the present invention relates generally to drainage foil apparatus for removing liquid from material carried across the foil by a moving foraminous conveyor. The liquid is drawn from the material through the conveyor and removed by the vacuum pressure and scraping action of the foil, as discussed in U.S. Pat. No. 2,928,465 of Wrist. In particular, such drainage foil apparatus is especially useful for removing the water from wood pulp stock in a paper making machine. However, the foil apparatus is also useful on other web forming machines such as those making non-woven fabrics.

At least the nose portion of the foil is made of hard crystalline ceramic material to provide a smooth wear-resistant upper surface on such nose portion which is a bearing surface engaged by the Fourdrinier wire or other foraminous conveyor. The rear portion of the foil has an upper foil surface which is spaced from the conveyor and may diverge from the plane of the bearing surface by a small angle to produce a vacuum pressure between such foil surface and the moving conveyor. The foil nose portion is made of a plurality of ceramic segments spaced laterally across the conveyor in order to reduce cost when the foil is damaged, since only the damaged segment need be replaced rather than the entire nose portion. The upper surfaces of the ceramic segments must be held in alignment with each other and the rear foil portion when it is a separate member, and accurately positioned with respect to the conveyor in order to prevent damage to the conveyor and to provide the negative pressure of the foil action. In order to provide such accurate positioning and to enable easy replacement of the ceramic segments, such segments are provided with a slot in their bottom surfaces and are bonded to a common mounting member of metal which extends into such slot. The slot and mounting member are shaped to enable each segment to be inserted on and removed from the mounting member without moving the other segments. As used herein, "Fourdrinier wire" refers to any pulp conveyor used on a paper making machine including a twin wire machine and those using synthetic plastic conveyors.

In addition, when the foil nose portion is separate from the rear portion of the foil which may be a member of a different material, such as a synthetic plastic, the ceramic nose members are resiliently urged into contact with the rear portion member by the metal mounting member to insure accurate positioning and to prevent any gaps between the bearing surface and the foil surface of such members.

The superior ceramic foil member mounting technique of the present invention not only assures accurate positioning but also enables easy replacement of damaged ceramic segments individually by unskilled personnel in the plant without stopping the paper making machine. This saves considerable time and expense which would otherwise be needed if all of the adjacent ceramic segments had to be removed before the damaged segment could be replaced, as is true of the prior art and the invention described in U.S. Pat. No. 3,870,597 of Getman et al. In this patent, ceramic nose portions are held in place by springs after the segments are slid longitudinally on and off the foil member in order to accurately position the ceramic segments relative to the conveyor wire. However, such spring mountings are not satisfactory because the different thermal expansion of the metal springs and ceramic segments causes spaces to open between the ceramic segments and between such segments and the rear foil member which will be filled with pulp and other foreign matter.

One embodiment of the above patent does show a slot in the bottom of the ceramic nose segments into which separate L-shaped metal spring members are provided. However, such springs are loosely held in a notch in the rear foil member and are not bonded to such segments so that they are subject to the above-discussed disadvantages. While such patent does disclose as prior art an all-ceramic foil having a dovetail slot in the bottom surface thereof and a dovetail mounting member apparently made of metal which extends into such slot, this foil apparatus has the disadvantage that in order to replace a single damaged ceramic segment, all of the adjacent segments would have to be removed by sliding them longitudinally along the mounting member. This requires that the foil apparatus be removed from the paper making machine and is quite time consuming. In addition, it also would prevent the ceramic segments from being bonded to the metal support. Other prior foil apparatus have attempted to solve the above problems by providing each of the ceramic nose segments with a projection on its lower surface which extends into a U-shaped metal channel mounting member or a notch in a metal support member. However, when the ceramic projection is bonded into the channel or notch, the nose member is very difficult to remove and replace among other reasons because the ceramic projection breaks off and remains within the channel or notch. The present invention overcomes these problems.

In one embodiment of the present invention employing a separate rear foil member of plastic material, either the top or bottom surfaces of such member can be employed as the foil surface which diverges from the conveyor wire by the proper angle of approximately 5° or less to create a vacuum pressure which sucks the water from the pulp through the conveyor. This lengthens the life of the foil member when the foil surface becomes coated with pitch or is damaged. In addition, the top and bottom surfaces of the rear foil member can provided with different angles of divergence to change the amount of vacuum pressure created when the member is inverted in its mounting position. This is different from the foil of U.S. Pat. No. 3,165,440 of Jordansson, which changes the foil angle by reversing the position of the front and back edges of the foil rather than inverting the foil. In the patented foil, the length of the upper surfaces of the front and rear portions are different, and therefore the foil in one position is not used most efficiently. This problem is overcome by the above-discussed embodiment of the present invention.

SUMMARY OF INVENTION

It is therefore one object of the present invention to provide an improved drainage foil apparatus for removing liquid from material carried on a foraminous conveyor and employing ceramic segments which when damaged can be individually replaced without moving the other segments.

Another object of the invention is to provide such a foil apparatus in which the rear foil portion is made of a separate member of non-ceramic material while the nose portion is made of a plurality of ceramic segments whose upper surfaces form the bearing surface of the conveyor for long useful life at low cost.

A further object of the present invention is to provide such a foil apparatus in which the rear foil member is provided with two foil surfaces on the top and bottom thereof which can both be used as the foil surface by inverting the foil member to increase the useful life of such foil member.

An additional object of the invention is to provide such a foil apparatus which is more versatile in that the rear foil member is provided with two foil surfaces which form different divergent angles with the plane of the bearing surface of the ceramic nose portions and cause different vacuum pressures to be created by such foil to regulate the amount of liquid removal.

Still another object of the present invention is to provide such an improved foil apparatus in which the ceramic segments are each provided with a slot in its bottom surface and are bonded to a common mounting member of metal extending into such slots to securely hold the ceramic segments accurately positioned relative to each other and to the conveyor.

A still further object of the present invention is to provide such a foil apparatus in which the slots and the mounting member are provided of such a shape to enable the ceramic members to be inserted on and removed from the mounting member without moving the other segments, thereby enabling easy replacement of damaged segments without requiring removal of other segments from the foil apparatus.

Another object of the present invention is to provide such a foil apparatus for removing water from wood pulp stock carried on a Fourdrinier wire in a paper making machine.

Other objects and advantages of the present invention will be apparent from the following drawings and detailed description of preferred embodiments thereof.

DRAWINGS

DESCRIPTION OF PREFERRED EMBODIMENTS

Figure 1:
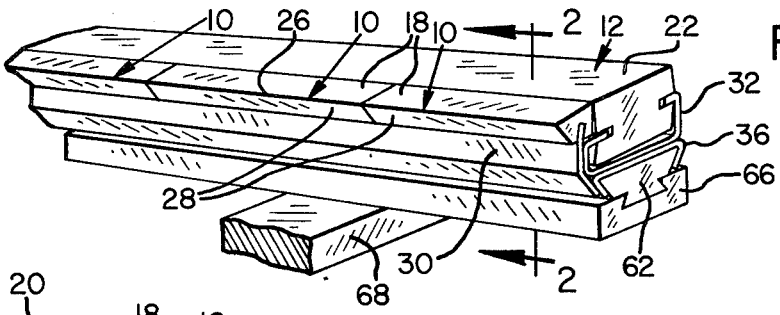
FIG. 1 is an oblique view of a portion of a drainage foil apparatus in accordance with one embodiment of the present invention.
Figure 2:
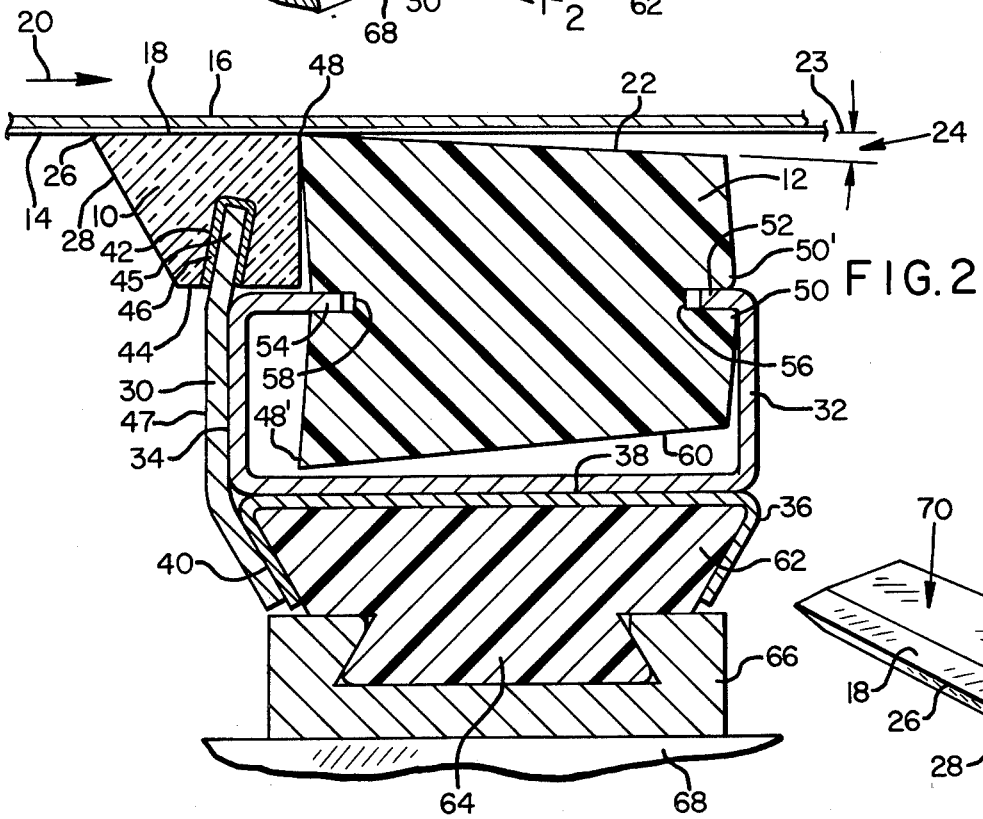
FIG. 2 is an enlarged vertical section view taken along line 2—2 of FIG. 1 showing one embodiment of the drainage foil apparatus.

As shown in FIGS. 1 and 2, the drainage foil apparatus of the present invention includes a nose portion 10 and a rear portion 12 which in this embodiment is a separate member of different material from the nose portion, such as ultra high density polyethylene plastic. The nose portion is formed of a plurality of nose segments 10 made of hard crystalline ceramic, such as sintered aluminum oxide, which are spaced laterally across the path of a foraminous conveyor 14 such as the Fourdrinier wire of a paper making machine. The conveyor carries wood pulp stock 16 or other material from which water or other liquid is to be removed by the foil. The ceramic nose segments each include an upper surface 18 which engages the conveyor 14 and provides a dynamic bearing surface which is polished smooth to a mirror finish of typically ten microinches RMS or better, so that such bearing surface will not damage the conveyor "wire," made of metal or synthetic plastic material. The bearing surface is a flat planar surface which extends parallel to the path of movement of the conveyor wire 14 in the direction of arrow 20. The upper surface 22 of the rear foil member 12 diverges from the plane 23 of the bearing surface 18 by a small acute angle 24 of approximately 5° or less, to produce a vacuum pressure between such foil surface 22 and the moving conveyor wire 14 carrying the stock 16. Thus, surface 22 is the foil surface which creates such vacuum by the foil action in the manner explained in U.S. Pat. No. 2,928,465 of Wrist. As a result of this vacuum pressure, water or other liquid in the stock 16 is drawn from the stock through the conveyor wire 14 and removed. Additional water is removed by a leading edge 26 on the front end of the nose portion 10 which is formed by the intersection of the bearing surface 18 with the front surface 28 of the foil. Thus, the leading edge 26 scrapes the bottom of the conveyor wire and removes water clinging to such wire which has drained from the stock through the wire.

In order to support the ceramic nose segments 10 and the rear foil member 12 accurately with respect to one another and with respect to the conveyor 14, such members are mounted on a metal support means including a metal plate mounting member 30 and a metal channel holder member 32. The mounting member 30 and the holder member 32 are fastened together at their contacting surfaces 34 by spot welding or the like and are also fastened to a lower mounting channel 36 by spot welding at contacting surfaces 38 and 40. All three of the metal support members 30, 32 and 36 are made of a non-corrosive metal such as type 304 stainless steel.

A rectangular slot 42 is provided in the bottom surface 44 of each of the ceramic nose segments 18, such slot extending laterally across the entire width of the conveyor 14. The top portion 45 of the mounting member 30 extends into the slot 42 and is bonded to the ceramic surfaces of such slot by bonding material 46 provided within such slot. The bonding material may be any suitable synthetic plastic such as epoxy resin, acrylic ester, polyester resin or even slicone rubber. However, such bonding material is preferably the type 324 modified acrylic ester sold by Loctite Corporation, because this material is a relatively brittle adhesive which breaks away cleanly when stressed above its maximum strength, thereby enabling easier removal of the ceramic segments during replacement of a damaged segment. The ceramic segments 10 may be made of any suitable hard crystalline ceramic material, but are preferably made of sintered alumina with an extremely high aluminum oxide content greater than about 99%, which is formed of fine particles pressed to extremely high density in order to enable a mirror finish to be obtained by diamond polishing the bearing surface 18. Of course, other ceramic materials could also be used, including silicon carbide.

The slot 42 and the top portion 45 of the mounting member 30 are rearwardly inclined at an angle of approximately 10° from the vertical front surface 47 of such mounting member. The mounting member resiliently urges the ceramic segments into contact with the front top edge 48 of the rear foil member 12. The rear surface of the rear foil member 12 contacts the inside of the channel member 32 at point 50 to hold such rear foil member against rearward movement. As a result, the ceramic nose segments 10 are resiliently clamped between the top portion 45 of mounting member 30 and the rear foil member 12. It should be noted that the distance between points 48 and 50 is maintained at a close tolerance of about ±0.001. Vertical movement of member 12 is prevented and the foil surface 22 is vertically positioned so that it is spaced from the conveyor 14 properly by means of two horizontal flange portions 52 and 54 of the channel member 32. Flange portions 52 and 54 define the top opening in the rectangular channel within such channel member. The flange portions 52 and 54 extend into notches 56 and 58, respectively, in the rear surface and the front surface of the rear foil member 12. Thus, notches 56 and 58 extend horizontally laterally across the conveyor 14 along the entire length of the foil apparatus.

The holder channel member 36 is formed of sheet metal of approximately 0.060 inch thickness, while the mounting plate member 30 is formed of a heavier sheet metal of about 0.110 inch thick, and the lower mounting channel 36 is formed of lighter sheet metal on the order of 0.035 inch thick. It should be noted that due to the rearward inclination of the top portion 45 of the mounting member and the resilient clamping of the ceramic segments, such segments cannot be removed from the foil apparatus until the rear foil member 12 is slid longitudinally out of the holder channel 32. Each ceramic nose segment 10 can then be removed by breaking the bonding material 46 and replaced by another segment without moving the ceramic segments on opposite sides thereof. Thus, when a ceramic nose segment is damaged, it can be replaced easily by unskilled labor at the paper mill.

The bottom surface 60 of the rear foil member 12 may be formed at the same or a different foil angle from the top surface 22, so that when the rear foil member is inverted and reversed end for end, such bottom surface is positioned adjacent the conveyor 14 and functions as the foil surface. For example, the foil angle 24 between surface 22 and the plane 23 of the bearing surface 18 may be 3°, while the foil angle (not shown) between surface 60 and the plane of the bearing surface 18 may be 5°. Thus, by inverting the position of the rear foil member 12 so that points 48' and 50' now occupy the position shown at 48 and 50 in FIG. 2, the foil angle may be changed and the amount of liquid removed from the pulp may be controlled. Alternatively, the two surfaces 22 and 60 may each form the same foil angle with the plane of the bearing surface 18, thereby giving the foil member a longer lifetime since the two surfaces may be interchanged when one surface becomes damaged or covered with pitch or other foreign matter from the pulp stock. It should be noted that the rear foil member 12 is substantially symmetrical about its axis extending between the centers of the notches 56 and 58 except when surfaces 22 and 60 provide different foil angles. Also, the front surface of the rear foil member 12 is relieved inwardly so that the portion of such front surface adjacent the notch 58 is spaced from the rear of the ceramic segments 10. This insures that the contact between the rear foil member 12 and the ceramic segments 10 occurs at the top edge contact point 48 so that no gap exists between the bearing surface 18 and the foil surface 22 or 60. In addition, the rear surface of the member 12 is also relieved at its top and bottom edges so that they are spaced away from the channel member 32. As a result, the rear surface of the rear foil member 12 only contacts the channel member 32 at point 50 adjacent slot 56.

The mounting channel 36 is provided with a mounting insert 62 of synthetic plastic material such as high density polyethylene. This mounting insert is held within the tapered trapezoidal shaped mounting channel formed in channel member 36 by the inwardly slanting legs of such channel member. A dovetail-shaped ridge 64 is provided on the bottom of the insert 62 for mounting the foil apparatus within a dovetail-shaped groove provided across the upper surface of a support bar 66 of stainless steel or other metal. The support bar is mounted on metal cross braces 68 rigidly secured to the paper making machine. Of course, mounting means can be employed other than the dovetail projection 64 and dovetail grooved support bar 66. For this purpose the plastic mounting insert 62 can be machined to provide it with appropriate grooves or projections to accomodate the various mounting means employed on different paper making machines.

Figure 4:
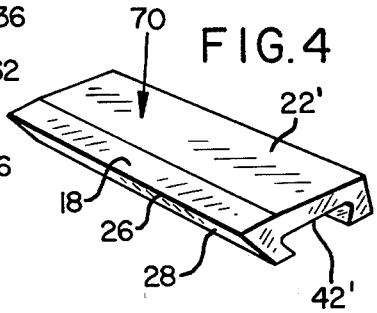
FIG. 4 is an oblique view of the top of one of the ceramic foil segments of FIG. 3.
Figure 3:
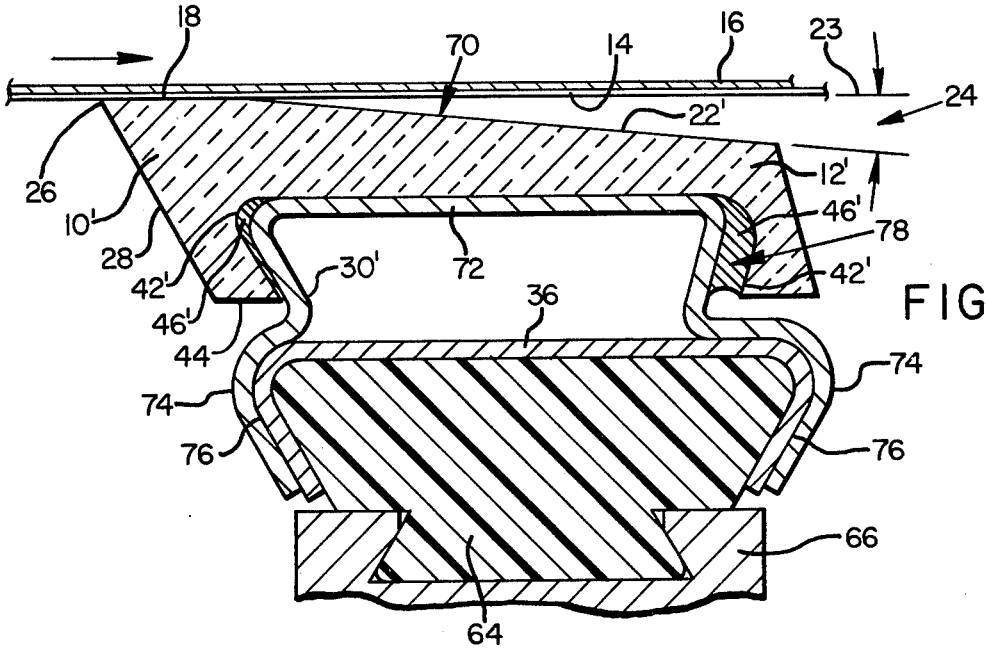
FIG. 3 is an enlarged vertical section view of another embodiment of the drainage foil apparatus of the present invention.

Another embodiment of the drainage foil apparatus of the present invention is shown in FIGS. 3 and 4. In this embodiment, both the nose portion 10' and the rear foil portion 12' are formed integral from the same segment 70 of ceramic material, and a plurality of such ceramic segments are spaced longitudinally across the conveyor 14 like segments 10 of FIGS. 1 and 2. Thus, the bearing surface 18 and the foil surface 22' are both provided on each of the ceramic segments 70. The same reference numerals have been employed to designate like parts in FIGS. 2 and 3. Therefore, only the differences in the embodiment of FIG. 3 will be described.

The mounting slot 42' has a cross section in the form of a tapered groove or dovetail and is provided in the bottom surface 44 of the ceramic segment 70 in a position beneath the foil surface 22'. The metal mounting member 30' is in the form of a channel member having a dovetail-shaped tongue portion 72 which extends upward into the mounting slot 42'. A pair of outwardly extending curved leg portions 74 of the mounting member 30' wrap around the opposite side edges of the mounting channel member 36 and are spot welded thereto at their contacting surfaces 76. It should be noted that the slot 42' is of larger width than the tongue member 72 to provide a clearance space 78 between the rear of the tongue and the rear end of the slot. This clearance space 78 is filled with bonding material 46' which in this embodiment is preferably polyester resin that cures at room temperature and provides adequate strength at the thicknesses required for filling space 78. While acrylic ester can be employed for the bonding material 46', it must be heat cured at the greater thicknesses required. This necessitates the use of a strip heater along the rear of the foil segment which is inconvenient, especially when replacing broken segments.

The clearance space 78 enables a damaged ceramic segment 70 to be removed from and a new segment inserted onto the tongue portion 72 of the mounting member 30' by pivoting such ceramic segment upward and downward in a direction lateral to the mounting member 30'. Thus, the ceramic segments 70 can be removed without moving adjacent ceramic segments, like the ceramic nose segments 10 of FIGS. 1 and 2. In both of the embodiments of FIGS. 2 and 4, the distance from the top of the support bar 66 to the bearing surface 18 is about 1.600 inch, while the distance from the leading edge 26 to the rear of the foil surface 22 or 22′ is about 2.125 inch in the example given. The length of each of the segments 10 and 70 may be up to about 12 inches, while the total length of the foil apparatus varies between about 10 and 20 feet, depending on the width of the conveyor 14.

It will be obvious to one having ordinary skill in the art that many changes may be made in the above described preferred embodiments of the present invention without departing from the spirit of the invention. Therefore, the scope of the present invention should only be determined by the following claims.

I claim:

1. A drainage foil apparatus for removing liquid from material carried across the upper surface of the foil by a moving foraminous conveyor, said foil apparatus comprising:

a foil including a nose portion of hard, crystalline ceramic material having a leading edge and an upper surface which is a smooth bearing surface engaged by said conveyor;

a foil rear portion having an upper surface spaced from the moving conveyor by a spacing distance sufficient to produce a vacuum pressure in the space therebetween;

said foil being made of a plurality of ceramic segments spaced laterally across said conveyor to form said nose portion and having an elongated slot provided in a lower surface portion of said ceramic segments and extending laterally across the conveyor;

support means for supporting said nose portion and rear portion so that their upper surfaces are positioned respectively to contact the conveyor and to produce said vacuum pressure;

said support means including a mounting member of metal which extends into said slot, said mounting member and slot being shaped to enable said ceramic segments to each be inserted on and removed from said mounting member without moving other segments; and bonding material provided within said slot.

2. A foil apparatus in accordance with claim 1 in which the nose portion and the rear portion are separate members, said rear portion being made of a different material from said nose portion.

3. A foil apparatus in accordance with claim 2 in which said rear portion is made of synthetic plastic material.

4. A foil apparatus in accordance with claim 2 in which the support means supports the nose portion and the rear portion in contact, and the mounting member resiliently urges said nose portion into contact with said rear portion adjacent their top edges.

5. A foil apparatus in accordance with claim 2 in which the nose portion member is made of a plurality of ceramic nose segments made of aluminum oxide ceramic material.

6. A foil apparatus in accordance with claim 4 in which the rear portion member is provided with a first foil surface on one side thereof which diverges from the plane of the upper surface of said nose portion by a first angle when said first surface is the upper surface of said rear portion, and is provided with a second foil surface on the opposite side thereof which diverges from said plane by a second angle when said second surface is in the upper surface of said rear portion, and said support means includes a holder means for supporting said rear portion member with either said first foil surface or said second foil surface as the upper surface.

7. A foil apparatus in accordance with claim 6 in which the holder means includes a channel member of which opposite edges defining a longitudinal opening in the channel are inserted into notches in the front and rear surfaces of said rear portion member.

8. A foil apparatus in accordance with claim 6 in which the first angle and the second angle are different angles of approximately five degrees or less.

9. A foil apparatus in accordance with claim 1 in which the nose portion and the rear portion are formed integral from the same foil member of ceramic material.

10. A foil apparatus in accordance with claim 9 in which the slot is provided in the lower surface below the foil surface of the rear portion.

11. A foil apparatus in accordance with claim 10 in which the slot and the mounting member are of a tapered tongue and groove shape.

12. A foil apparatus in accordance with claim 1 in which the bonding material forms a ceramic to metal bond between the foil and the mounting member.

13. A foil apparatus in accordance with claim 12 in which the bonding material is a synthetic material taken from the group consisting of acrylic ester, epoxy resin, polyester resin and silicone rubber.

14. A drainage foil apparatus for removing liquid from paper pulp stock carried on a foraminous conveyor in a paper making machine, said foil apparatus comprising:

a foil including a nose portion of crystalline ceramic material having a leading edge and an upper surface which provides a smooth bearing surface that is engaged by the conveyor carrying said stock across said foil;

a foil rear portion having an upper surface which provides a foil surface that diverges rearwardly from the plane of said bearing surface and is spaced below said conveyor sufficiently to produce a vacuum between said foil surface and said conveyor;

said foil having an elongated slot provided in a lower surface portion of ceramic material and extending laterally across the conveyor;

support means for supporting said nose portion and rear portion so that their upper surfaces are positioned respectively to contact the conveyor means and to produce said vacuum, said support means including a mounting member of metal which extends into said slot; and bonding material in said slot for bonding said mounting member to said foil.

15. A foil apparatus in accordance with claim 14 in which the foil is made of a plurality of ceramic segments spaced laterally across the conveyor and with said slot provided therein, said mounting member and said slot being of such a shape to enable insertion and removal of one ceramic segment without movement of the other ceramic segments on said mounting member.

16. A foil apparatus in accordance with claim 14 in which the nose portion and the rear portion are separate members and the rear portion is made of a synthetic plastic material.

17. A foil apparatus in accordance with claim 16 in which the slot is provided in the bottom of the ceramic nose portion and slopes rearward relative to a perpendicular to the bearing surface, said mounting member being a metal plate inserted into said slot resiliently biasing said nose member into contact with said rear member.

18. A foil apparatus in accordance with claim 14 in which the nose portion and rear portion are both formed integral with the same ceramic member.

19. A foil apparatus in accordance with claim 18 in which the slot is provided in the bottom of said rear portion, said slot and mounting member being of a tapered tongue and groove shape.

* * * * *